United States Patent [19]

Hinchcliffe

[11] Patent Number: 4,562,099

[45] Date of Patent: Dec. 31, 1985

[54] APPARATUS FOR APPLYING ADHESIVE

[75] Inventor: Dennis Hinchcliffe, London, England

[73] Assignee: Molins PLC, London, England

[21] Appl. No.: 573,275

[22] Filed: Jan. 18, 1984

[30] Foreign Application Priority Data

Feb. 1, 1983 [GB] United Kingdom ..... 8302663
Dec. 3, 1983 [GB] United Kingdom ..... 8332328

[51] Int. Cl.[4] ..... B05C 1/02

[52] U.S. Cl. ..... 427/282; 118/406; 118/212; 427/428

[58] Field of Search ..... 118/406, 212, 213; 101/116, 119, 120, 170; 427/282, 428, 256

[56] References Cited

U.S. PATENT DOCUMENTS 2,424,949 7/1947 White ..... 101/116 X
3,102,046 8/1963 Bushey ..... 101/116 X
3,613,635 10/1971 Brehm ..... 118/406
3,919,973 11/1975 Zimmer ..... 118/406
4,379,185 4/1983 Smith et al. ..... 118/406 X

FOREIGN PATENT DOCUMENTS 1342504 1/1974 United Kingdom .
1433362 4/1976 United Kingdom .
1543281 4/1979 United Kingdom .

*Primary Examiner*—John P. McIntosh
*Attorney, Agent, or Firm*—John C. Smith, Jr.

[57] ABSTRACT

A gravure-type gummer comprises a hollow cylindrical member 18 partly immersed in an adhesive container 10 and adapted to transfer a pattern of adhesive to a blank B movable in contact with the top of the member. The adhesive is held in a pattern of round bores 24 extending through the member, whose inside and outside peripheral surfaces are scraped clean of adhesive by scrapers 26 and 28.

11 Claims, 5 Drawing Figures

APPARATUS FOR APPLYING ADHESIVE

This invention relates to apparatus for applying adhesive to sheet-like material, for example blanks of wrapping materials, partly formed packages and webs of material generally.

A well known manner of applying a pattern of adhesive to a web, or to a discontinuous sheet, is to use a cylindrical member formed with recesses of the corresponding pattern, the member being partly immersed in a receptacle or trough of adhesive and the remainder of the periphery of the cylindrical member being scraped clean so that adhesive is applied by contacting the surface of the cylinder with the web or the sheet. This type of adhesive application is sometimes known as gravure gumming, and a typical example of such apparatus is described in U.S. Pat. No. 1,793,082 to H. J. Goss. There the pattern of adhesive is formed by groups of small recesses or pockets. Such recesses may be more suitable for gravure printing, in which the ink fluid to be transferred is of a far lower viscosity than adhesive, and where the ink material is transferred by the application of high pressures onto material to which the ink is to be printed. But with adhesive there is a danger of the recesses becoming gradually clogged or blocked up, so that no new fresh adhesive can be received in those recesses, with the result that there is a failure to transfer the pattern of adhesive.

It has been proposed to overcome this difficulty by widening the recesses to form transverse grooves extending from one side of the cylindrical member to the other. However this is only satisfactory when the width of the cylindrical member is small in relation to the depth of the grooves, otherwise the same clogging problem arises, though more slowly than with recesses.

According to one aspect of the present invention there is provided apparatus for applying adhesive to a sheet-like material, comprising a hollow cylindrical member having a relatively thin peripheral wall with internal and external surfaces and supported for rotation about a horizontal axis, a pattern of perforations extending through said wall, means for supplying adhesive to a portion of the member, and scraper means directed against said internal and external surfaces for removal of excess adhesive, whereby the perforations are filled with adhesive for direct application to the sheet-like material.

The scraper means may comprise inner and outer scrapers of which the inner scraper is positioned upstream relative to the outer scraper, as considered in the direction of rotation of the member.

The inner scraper may be made of a plastics or rubber-like material, and may be slightly spaced from said internal surface, since the inner scraper only requires to remove general excess glue from the internal periphery. The outer scraper, on the other hand, is in contact with the external surface of the peripheral wall so as to scrape that surface very clean, in particular those areas where there are no perforations, i.e. where no adhesive is to be applied to the sheet-like material.

An adhesive applying apparatus according to another aspect of the invention comprises a cylindrical gravure gumming member having a pattern of apertures formed in its peripheral surface, some of which apertures are larger than others, so that such larger apertures apply adhesive in a thicker or denser layer than that applied by the other apertures.

Said larger apertures may be deeper than other apertures, and may take the form of axial grooves where the cylindrical member is solid. Alternatively where the cylindrical member is hollow, said larger apertures may comprise larger holes through the peripheral wall of the hollow member.

An example of apparatus according to the invention will now be described with reference to the accompanying drawings, in which.

Figure 1:
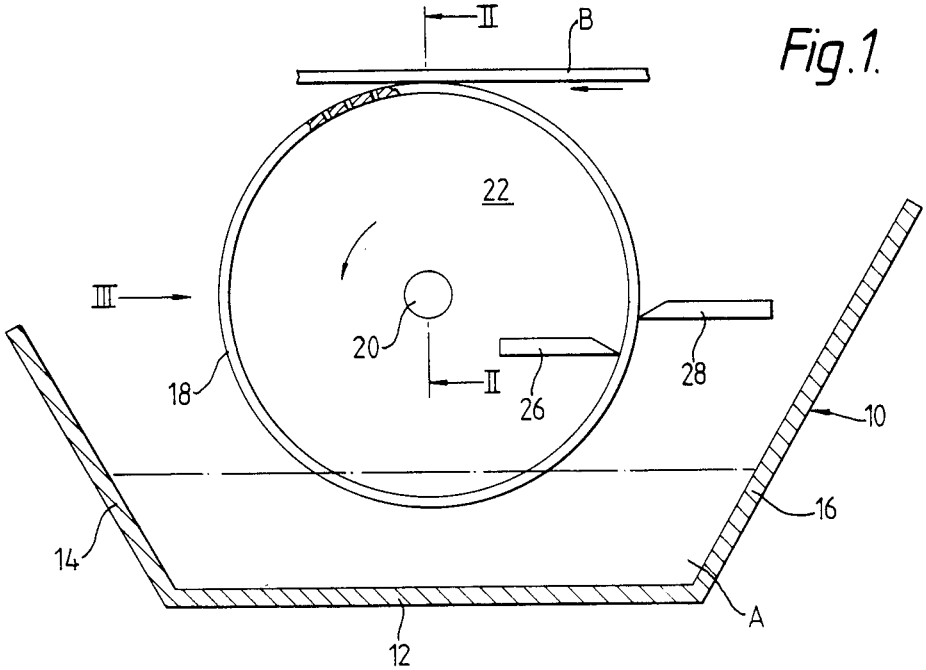
FIG. 1 is a side view of the apparatus.

Referring first to FIG. 1 of the drawings, there is shown a receptacle or container 10 for adhesive A, comprising a base 12 and two inclined sides 14 and 16 of which the right hand side 16 as viewed in FIG. 1 is higher than the left-hand side 14. The front and back of the container are enclosed by vertical walls (not shown).

Figure 2:
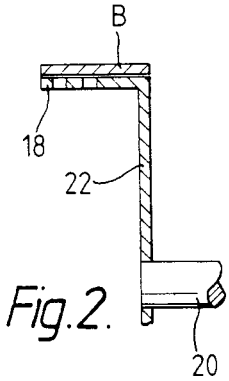
FIG. 2 is a section of a drum taken on the line II—II of FIG. 1.

Dipping into the container 10 is a hollow cylindrical gravure drum 18 mounted on a shaft 20 for rotation in an anti-clockwise direction, the drum being supported from the shaft by a circular disc 22 integral with the drum (see also FIG. 2).

Figure 3:
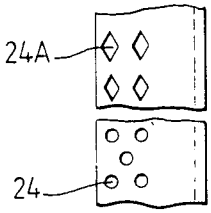
FIG. 3 is a scrap view of the periphery of the drum taken in the direction of arrow III in FIG. 1.

Formed in the relatively thin peripheral wall of the drum 18 is a pattern of perforations. As best seen in FIG. 3, these are preferably in the shape of circular apertures 24 (or alternatively of diamond shaped apertures 24A). The diameter of the apertures 24 is about the same as the depth of the apertures, so that they are approximately square in the section as seen in FIG. 2. The actual diameter and depth of the apertures chosen will depend on various factors, in particular on the viscosity of the adhesive to be used (for example, whether a PVA or a hot melt adhesive). However, a typically suitable diameter of the apertures may be about 1 mm.

Mounted to the right of the drum 18 are a pair of inner and outer scrapers 26 and 28 having chisel-edged or pointed ends engagable respectively with the internal and external peripheries of the drum. The outer scraper 28 is at a position below the centre line of the shaft 20 and is made of a pointed metallic material mounted close to the drum 18, the drum itself being made of a material such as stainless steel to resist corrosion by the adhesive.

The inner scraper 26 is at the level below the outer scraper 28 so that it is at a position upstream of the drum as considered in the direction of its rotation. The inner scraper 26 may be made of a softer material than the outer scraper and may be made of a rubbery or plastics material, for example nylon. There is a small clearance or spacing of the pointed end of the inner scraper from the internal periphery of the drum, in contrast to that of the outer scraper 28 which is preferably in close contact with the external periphery.

The outer annular portion of the supporting disc 22, which in use will also be wetted by the adhesive A, is similarly scraped clean by internal and external scrapers (not shown) which may form part of the scrapers 26 and 28.

A sheet blank B is fed horizontally and tangentially across the top of the drum 18. The sheet B is fed on guides (not shown) over the drum 18 and is brought into contact with the drum by a backing roller or fixed deflector (not shown).

The operation of the adhesive applicator described is fairly self-evident. The container 10 is filled with an adhesive A to a level just above the inside peripheral surface of the drum 18 so that the apertures 24 are properly filled with adhesive. On rotation of the drum 18 the inside periphery of the drum is scraped generally clean by the scraper 26 followed by a very clean scraping by the outer scraper 28. The resulting "slug" or measure of adhesive in each aperture then rotates to the top, where a part of it is deposited against the undersurface of the sheet B while a residue remains in the aperture.

Due to the relatively small cylindrical area of each aperture in contact with the adhesive and the fact that the aperture is also open at the inside, it is believed that there is a gradual replacement of said residue of adhesive in each aperture, particularly from inside, so that there is a radially outward scavenging action with the result that the formation of dried adhesive in the aperture is prevented. Furthermore the deposition of adhesive on to the sheet B can be accomplished using only a light pressure on the sheet from said backing roller or fixed deflector, which reduces the risk of adhesive contamination therewith when a sheet is missing.

Figure 4:
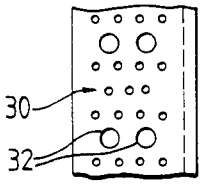
FIG. 4 is a modification of FIG. 3.

FIG. 4 shows a modification of the pattern of perforations in the drum. Indicated at 30 are three axial rows of circular apertures or holes which are of small diameter. These small holes 30 are followed by an axial row of two larger diameter holes 32, and the pattern is then repeated.

In use such perforations will apply adhesive to an article, such as the sheet B, in a pattern of three rows of small dots of adhesive which will be thin or shallow (as the cylindrical area of each hole 30 for retaining adhesive is relatively large compared with its peripheral area), followed by a row of two relatively thick blobs of adhesive. When the sheet is applied to another surface to be adhered to it, the rows of shallow adhesive will dry more quickly than the row of two thick blobs, which however will spread out more densely and tend finally to provide a stronger bond between the surfaces to be joined. Furthermore the thick blob will adhere the two surfaces together even if they are not brought into close enough contact for the rows of shallow adhesive to form an adhesive bond. This may be particularly important in forming packages such as hinged lid cigarette packets, for example, where it cannot always be ensured that the outer side flaps are maintained in flat intimate contact with the underlying inner side flaps during drying of the adhesive.

The same principle as described with reference to FIG. 4 may be adopted in other gravure gumming applicators where the cylindrical member is solid and its periphery has a pattern of blind recesses or grooves, i.e. not open to the interior. For example, the grooves may be transverse and consist of a repeating pattern of three shallow grooves of about 0.1 mm depth followed by a deeper groove of about 0.3 mm depth.

Figure 5:
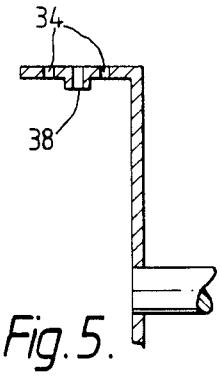
FIG. 5 is a further modification of the drum in a sectional view similar to FIG. 2.

In the further modification shown in FIG. 5 the internal peripheral surface of the drum is annularly ridged and provided with perforations 38 deeper than the perforations 34 at each side of the ridge. The inner scraper will, of course, need to have a notch corresponding to the ridged section at the inside of the perforations 38.

The perforations 34 and 38 may be cylindrical or oval, or may even extend circumferentially in interrupted grooves around the periphery of the drum. In all cases the effect is similar to that described in relation to FIG. 4, in that the dots or stripes of adhesive applied by the perforations 34 will provide a quick adhesive bond whereas that applied by the deeper perforations 38 will tend to provide a stronger bond and/or will bridge any surfaces to be adhered which are not in close contact.

I claim:

1. Apparatus for applying adhesive in a predetermined pattern to a sheet-like material comprising:

(a) a hollow cylindrical member having a relatively thin peripheral wall defined by internal and external surfaces thereof;

(b) means mounting said cylindrical member for rotation in a predetermined direction along a circular path about a substantially horizontal axis;

(c) a plurality of perforations arranged in said predetermined pattern extending through said peripheral wall;

(d) a receptacle adapted to contain a supply of liquid adhesive, said receptacle being positioned at a first position along said path under said cylindrical member so that during rotation of said cylindrical member a lower portion of said peripheral wall dips into said liquid adhesive in said receptacle to fill said perforations in said peripheral wall with said liquid adhesive; and (e) a fixed inner scraper blade and a fixed outer scraper blade mounted above the level of said adhesive in said receptacle and directed respectively at said internal and external surfaces of said peripheral wall at at least one further position along said path downstream of said first position, as considered in the direction of rotation of said cylindrical member, to remove excess adhesive from said inner and outer surfaces of said peripheral wall while leaving said liquid adhesive filling said perforations in said peripheral wall retained in said perforations;

(f) whereby adhesive retained in said perforations in said peripheral wall may be deposited in said predetermined pattern on a surface of said sheet-like material in contact with said external surface of said peripheral wall at another position along said path downstream of said at least one further position, as considered in the direction of rotation of said cylindrical member.

2. Apparatus as claimed in claim 1 in which said inner scraper is positioned upstream relative to said outer scraper, as considered in the direction of rotation of said cylindrical member.

3. Apparatus as claimed in claim 2 in which the inner scraper is made of a plastics or rubber-like material.

4. Apparatus as claimed in claim 2 in which the inner scraper is slightly spaced from the internal surface of said peripheral wall.

5. Apparatus as claimed in claim 1 in which said pattern of perforations in the peripheral wall comprises alternate large and small perforations.

6. Apparatus as claimed in claim 5 in which said large and small perforations are circular holes arranged in alternate axially oriented rows.

7. Apparatus as claimed in claim 5 further comprising at least one annular ridge formed in the internal surface of said peripheral wall, a portion of said perforations in said peripheral wall being positioned along said at least one annular ridge and the remaining portion of said perforations in said peripheral wall being spaced from said at least one annular ridge, whereby the perforations in said at least one annular ridge are of greater depth than said perforations of said remaining portion.

8. A method for applying adhesive arranged in a predetermined pattern on a sheet-like material comprising:

(a) rotating a hollow cylindrical member, having a relatively thin peripheral wall defined by internal and external surfaces and having a plurality of perforations arranged in said predetermined pattern extending through said peripheral wall, in a predetermined direction along a circular path about a substantially horizontal axis;

(b) dipping said peripheral wall into a body of liquid adhesive at a first position along said path below said substantially horizontal axis to fill said perforations in said peripheral wall with said liquid adhesive;

(c) scraping said internal and external surfaces of said peripheral wall at at least one further position along said path downstream of said first position, as considered in the direction of rotation of said cylindrical member, to remove excess adhesive from said inner and outer surfaces of said peripheral wall while leaving said liquid adhesive, filling said perforations in said peripheral wall, retained in said perforations in said peripheral wall; and (d) positioning a surface of said sheet-like material in contact with said external surface of said peripheral wall at another position along said path downstream of said at least one further position, as considered in the direction of rotation of said cylindrical member, to deposit adhesive retained in said perforations on said surface of said sheet-like material in said predetermined pattern.

9. A method for applying adhesive arranged in a predetermined pattern on a sheet-like material comprising (a) feeding a thin wall member, defined by first and second surfaces and having a plurality of perforations arranged in said predetermined pattern extending through said wall, in a predetermined direction along a predetermined path;

(b) dipping said wall member into a body of liquid adhesive at a first position along said path to fill said perforations in said wall member with said liquid adhesive;

(c) scraping said first and second surfaces of said wall member at at least one further position along said path downstream of said first position, as considered in the direction of movement of said wall member, to remove excess adhesive from said first and second surfaces of said wall member while leaving said liquid adhesive, filling said perforations in said wall member, retained in said perforations in said wall member; and (d) positioning a surface of said sheet-like material in contact with said first surface of said wall member at another position along said path downstream of said at least one further position, as considered in the direction of movement of said wall member, to deposit adhesive retained in said perforations on said surface of said sheet-like material in said predetermined pattern.

10. Apparatus for applying a plurality of spaced islands of liquid adhesive in a predetermined pattern to a sheet-like material comprising:

(a) a hollow cylindrical member having a relatively thin peripheral wall;

(b) a plurality of spaced perforations arranged in said predetermined pattern and extending through said peripheral wall;

(c) a first portion of said perforations in said peripheral wall having a greater depth, considered in a direction transverse to the plane of said peripheral wall, than the remaining portion of said perforations in said peripheral wall which have a lesser depth;

(d) such that, when said perforations in said peripheral wall are filled with liquid adhesive and a surface of said sheet-like material is placed in contact with the external surface of said peripheral wall, the islands of adhesive deposited on said surface of said sheet-like material by the perforations of said first portion having a greater depth are thicker or denser than the islands of adhesive deposited by the perforations of said remaining portion.

11. A method for applying a plurality of spaced islands of liquid adhesive arranged in a predetermined pattern on a sheet-like material comprising:

(a) filling a plurality of spaced perforations arranged in said predetermined pattern in a thin peripheral wall of a rotatable hollow cylindrical member and substantially excluding said liquid adhesive from the interior and exterior surfaces of said peripheral wall, a first portion of said peforations in said peripheral wall having a greater depth considered in a direction transverse to the plane of said peripheral wall, and containing a greater volume of said adhesive than the remaining portion of said perforations in said peripheral wall which are of lesser depth and contain a lesser volume of said adhesive; and (b) positioning a surface of said sheet-like material in contact with said external surface of said peripheral wall to deposit adhesive retained in said perforations as said islands on said surface of said sheet-like material in said predetermined pattern, said islands of adhesive deposited by the perforations of said first portion having a greater depth being thicker or denser than the islands of adhesive deposited by the perforations of said remaining portion having a lesser depth;

(c) whereby the adhesive contained in said smaller islands will dry more quickly than the adhesive contained in said larger islands, and the adhesive contained in said larger islands will provide a stronger bond between joined surfaces than the adhesive contained in said smaller islands.

* * * * *